US005630530A

United States Patent [19]

Geier et al.

[11] Patent Number: 5,630,530

[45] Date of Patent: May 20, 1997

[54] DISPENSING MODULE

[75] Inventors: Adalberto Geier, Villazzano; Giuseppe Dalsant, Baselga di Pine, both of Italy

[73] Assignee: Coster Tecnologie Speciali S.p.A., Italy

[21] Appl. No.: 509,747

[22] Filed: Aug. 1, 1995

[30] Foreign Application Priority Data

Aug. 1, 1994 [DE] Germany ..... 44 27 175.1

[51] Int. Cl.[6] ..... B65D 35/28

[52] U.S. Cl. ..... 222/95; 222/402.1

[58] Field of Search ..... 222/95, 402.1, 222/402.16

[56] References Cited

U.S. PATENT DOCUMENTS 4,969,577 11/1990 Werding ..... 222/95

FOREIGN PATENT DOCUMENTS 9010583 9/1990 Germany .
4131437 3/1993 Germany .
4131436 3/1993 Germany .
0585908 9/1993 Germany .

*Primary Examiner*—Gregory L. Huson
*Attorney, Agent, or Firm*—Andrus, Sceales, Starke & Sawall

[57] ABSTRACT

A dispensing module for use in the dispensing of pressurized liquids, foams, gels or the like comprises the combination of a dispenser valve (12) and a flexible bag (24) which is bonded thereto. The bag (24) is intended to be located within an outer container (22) by way of an opening (23) in the latter that can be closed with a lid (25). Disposed within the bag (24) is a delivery nozzle (58) that can be connected to the valve body (14) of the dispenser valve (12) through the bag material with the interposition of a sealing ring (32) in such a way that between the interior (52) of the bag and the valve body (14) fluid communication is maintained. The delivery nozzle (58) and/or the valve body (14) is made of a material that is fracture-proof and in particular not permeable to organic media. The portion (34) of the delivery nozzle (58) immediately adjacent to the bag (24) is provided with a surface or a covering (36) of a material, such as polyethylene, polypropylene or polyamide, which can be bonded to the bag material.

9 Claims, 4 Drawing Sheets

DISPENSING MODULE

FIELD OF THE INVENTION

The invention relates to a dispensing module for use in the dispensing of pressurized liquids, foams, gels or the like and comprises the combination of a dispenser valve and a flexible bag which is bonded thereto.

DESCRIPTION OF THE PRIOR ART

A module of this type is described in WO 90/10583. In this module, part of the dispenser valve extends through the bag, which is tightly bonded to the valve body of the dispenser valve. This arrangement prevents emergence of the bag contents through a gap between bag and dispenser valve, and ensures stable attachment.

The bag conventionally used comprises a flexible film material composed of several layers. The innermost layer is usually polyethylene or polypropylene.

One of the characteristics of the materials polyethylene and polypropylene is that they can readily be bonded only to themselves or to one another, i.e. to polyethylene or polypropylene. Bonding to another material has proved not to be durable. Because the bag is bonded directly to the dispenser valve, the consequence is that the dispenser valve must also be made of polyethylene or polypropylene. However, these materials have the disadvantage of being both fragile and permeable to organic media. Hence the dispenser valve can easily break within the container if the container falls to the ground.

The permeability to organic media is also extremely disadvantageous. For example, when the bag is filled with a gel the latter may contain isopentane, which must be kept under pressure and foams at about 34° C. If an organic medium such as butane, a material well-tolerated by the environment, is used as a pressurizer with a module in which the dispenser valve is made of polyethylene or polypropylene, the butane diffuses slowly through the dispenser valve and the pressure equilibrates between the bag and the interior of the container. Similarly, a medium contained in the gel, in particular a solvent, can diffuse out of the bag.

Experiments have shown that when, for example, polyethylene is used for the dispenser valve and butane as the pressurizer in a spray or foam can, by the time the can has been stored for about 6 to 7 months the pressure has equilibrated between bag and container to such an extent that it is impossible to ensure a guarantee period of 2 to 3 years, as is demanded nowadays. The spray or foam can would have become nonfunctional long before such a guarantee period has elapsed. Furthermore, the above-mentioned diffusion alters the contents of the can and may even make them unusable.

The object of the present invention is to overcome the aforementioned disadvantages of conventional dispensing modules in order to provide a dispensing module of the kind cited at the outset that is resistant to breaking, in which an exchange of individual materials, in particular organic media, between the interior of the bag and its surroundings is effectively prevented, and in which good bonding between bag and dispenser valve can be obtained.

SUMMARY OF THE INVENTION

According to the present invention there is provided a dispensing module for use in the dispensing of a pressurized medium comprising a dispenser valve and a bag of flexible material bonded thereto, the bag being capable of location within an outer container by way of a first opening which is defined by the container and which is closable with a lid, the dispenser valve comprising a valve body attachable to the rim of a second opening defined by the lid; a discharge nozzle disposed within the valve body and defining a discharge channel therethrough which is accessible from the valve body via a discharge aperture; spring means disposed in combination with the discharge nozzle whereby the discharge nozzle can be displaced axially out of a closed position against the action of the spring means; a resilient sealing member disposed between the rim and the valve body to enclose the discharge nozzle in such a way that when the discharge nozzle is in the closed position, the member closes the discharge aperture that gives access to the discharge channel; a delivery nozzle disposed within the bag and connected to the valve body through the bag material, the portion of the delivery nozzle that adjoins the bag being provided with a surface material which can be bonded to the bag material; and a sealing means interposed between the delivery nozzle and the valve body in such a way that fluid communication is maintained between the interior of the bag and the valve body; and at least one of the delivery nozzle and the valve body being made of a fracture-resistant material that is substantially impermeable to organic media.

Thus, to eliminate the disadvantages described above, on the one hand the delivery nozzle is made of a material resistant to breaking and, in particular, impermeable to organic media; and on the other hand, that portion of it which adjoins the bag has a surface or covering comprising a material that can be firmly bonded with the bag material. As a result, storage times of three or more years are readily achievable, so that guarantee periods of corresponding duration can be given.

For simplicity of manufacture, the delivery nozzle is preferably provided with a covering by means of a sleeve that can be pushed fitted or placed over part of the delivery nozzle. The nozzle itself can then be made entirely of an unbreakable material that is impermeable to organic media. The sleeve is also easy to manufacture and comprises a material that can readily be bonded to the inner surface of the bag material.

Advantageously, the delivery nozzle comprises a collar which is disposed within and adjoins the bag to delimit an annular space around the delivery nozzle opening toward the interior of the bag. This collar has the effect of stabilizing the delivery nozzle. In addition, this feature provides a larger area for bonding with the bag material, so that the latter does not hear away under the slightest stress.

When such a collar is used, preferably the collar comprises that portion of the delivery nozzle that adjoins the bag and is provided with a surface material which can be bonded to the bag material.

Preferably also, the delivery nozzle comprises a tubular portion which is push fitted through an opening defined by the bag into an associated opening defined by the valve body in such a way that the valve body is in fluid communication with the interior of the bag with no leakage into the interior of the outer container. This kind of construction allows the delivery nozzle and the valve body to be manufactured separately. To assemble the module, an opening is formed in the bag material prior to the material being shaped into the bag, and the tubular portion of the delivery nozzle is pushed through this opening and inserted into the valve body where it locks or clips into place. When the edges of the bag material have been bonded together to form the bag, the dispensing module is complete. In the course of the edge bonding process, the bag is also bonded to the delivery nozzle.

Preferably also, an ascent tube is attached to the delivery nozzle that extends substantially to the bottom of the bag. The contents at the bottom of the bag can ascend through this tube so that the bag is more completely emptied. The ascent tube also increases the stability of the bag.

The delivery nozzle preferably defines a lateral opening into the annular space surrounding the delivery nozzle whereby an additional fluid connection to the interior of the bag is defined. This lateral opening near the top of the bag provides an additional site of fluid communication between the interior of the bag and the valve body, by means of which the bag contents can be expelled by way of the dispenser valve. Thus if the middle part of the bag should become constricted, the upper part can still be emptied.

Advantageous materials for the valve body and the delivery nozzle are polyacetals; the sleeve or nozzle surface bonded to the bag material preferably comprises polyethylene, polypropylene, polyamide or similar material. The polyacetal material used for the valve body and delivery nozzle is resistant to breakage and not permeable to organic media, whereas the materials that can be used for the sleeve bond well to the inner layer of the bag.

The present invention and additional features and advantages thereof will now be described by way of example with reference to the accompanying drawings.

DESCRIPTION OF THE PREFERRED EMBODIMENTS

Figure 1:
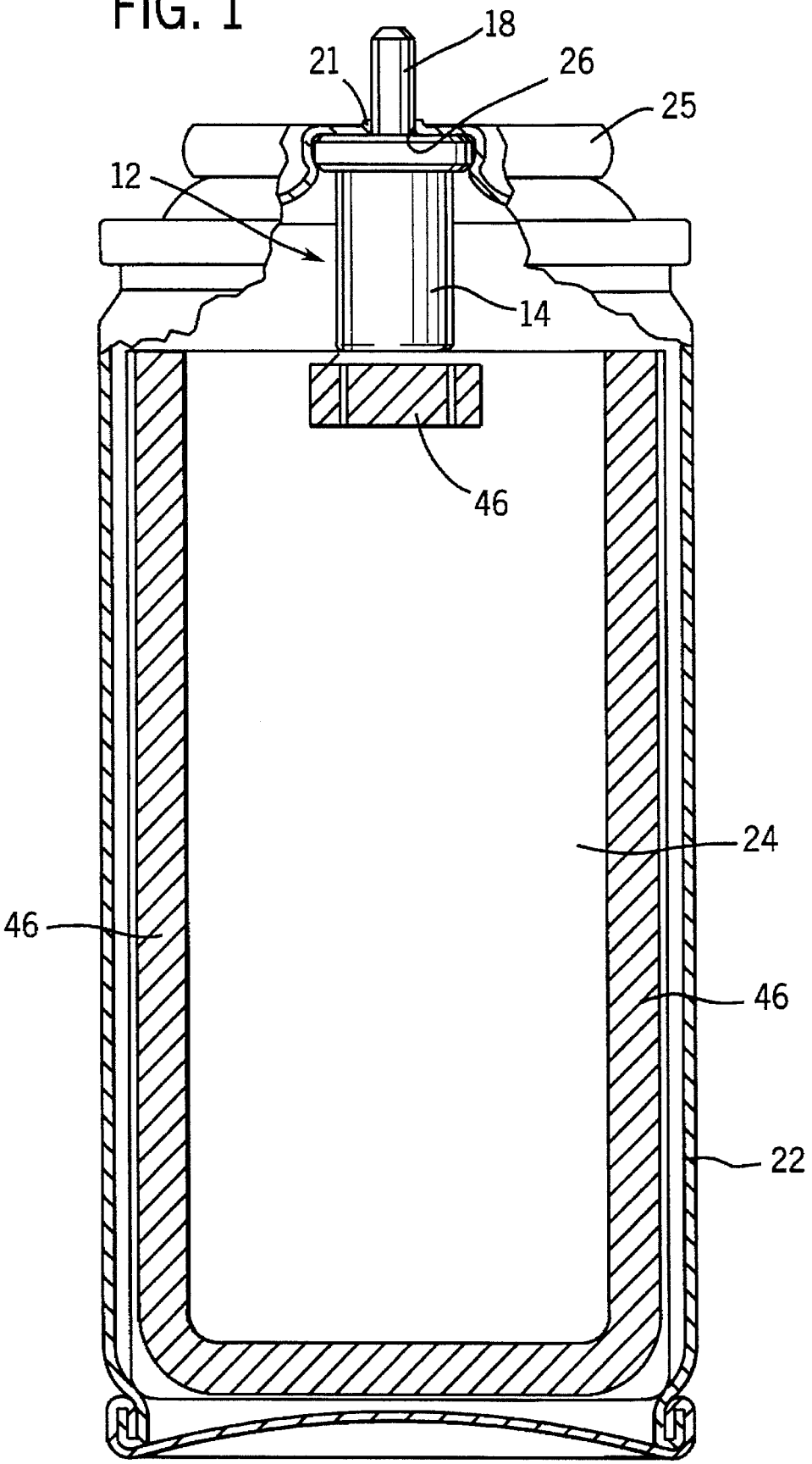
FIG. 1 is a side view of a dispensing module according to the invention installed in a container, the wall of the container being partially broken away.
Figure 2:
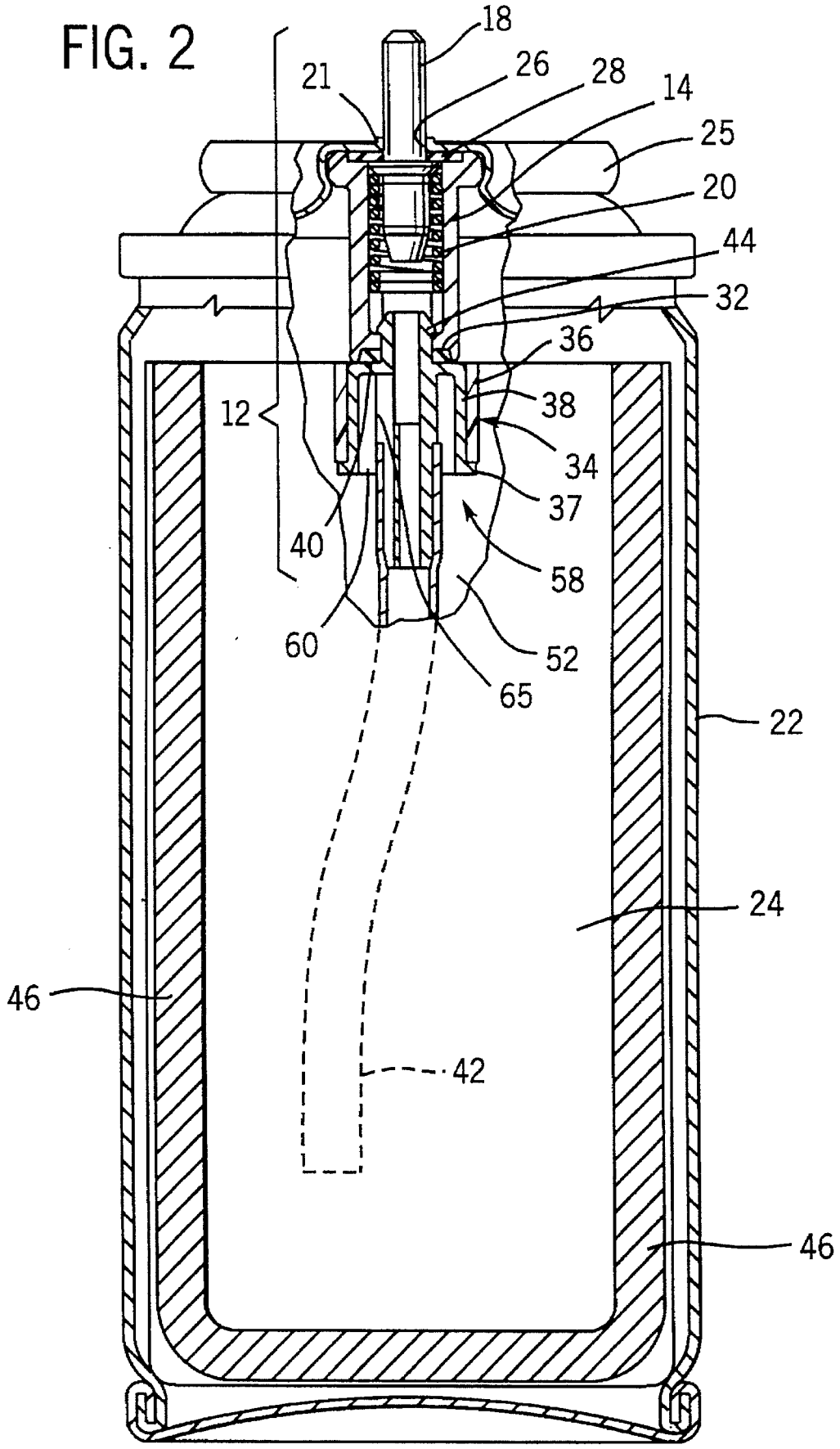
FIG. 2 is a view similar to that of FIG. 1, in which a bag of the module is also partly broken away and a dispenser valve of the module is shown in section.

In FIGS. 1 to 6 there is shown a dispensing module comprising a dispenser valve 12 to which is bonded a bag 24. An outer container 22, which for example can be made of tinplate or plastic, encloses the bag 24 in such a way as to define a receptacle space between these two components. The container 22 has at its upper end an opening 23 through which the bag 24 is inserted into the container 22 and within which, after the bag has been inserted, the dispenser valve 12 is seated, projecting above the container 22. The opening 23 is closed off in the customary way by means of a lid 25. The lid 25 in turn defines a lid opening 26. The rim 21 of this lid opening 26 holds in place a valve body 14 of the dispenser valve 12, in such a way that a discharging nozzle 18 passes through the lid opening 26. The nozzle 18 can thus be actuated from outside the container.

The bag 24 and the container 22 thus constitute a two-chamber package, such that the bag 24 (in the present exemplary embodiment) contains or can be filled with liquid or pasty contents and the container 22 contains or can be filled with a pressurizing medium, such as air or butane.

Initially, as will be explained in detail below, the bag or container can be filled with the above-mentioned contents by way of the dispenser valve 12. During the filling process the bag 24 expands within the container 22 so as to occupy a substantial part of the volume of the container 22. As the bag 24 is emptied, the bag contents are pressed out by way of the dispenser valve 12, through the discharging nozzle 18, with a corresponding expansion of the pressurizing medium in the container 22.

The bag 24 comprises a flexible film material constructed of several layers. In the present case the material comprises three layers, namely an outer polyamide or polyester layer, a middle aluminum layer and an inner polyethylene or polypropylene layer.

The bag 24 occupies the whole length of the space within the container 22. It is formed by folding over a material of the kind described above and bonding or sealing the edges of the folded material together, as at 46.

As will be explained in greater detail below, the bag 24 is held in place by leakproof bonding to a section of the dispenser valve 12.

The discharging nozzle 18 is axially disposed within the valve body 14 so that it can be slid from a closed to an open position and conversely. The nozzle 18 can be moved out of its closed position against the action of a spring means such as compression coil spring 20. The compression coil spring 20 is seated at one end in the lower region of the valve body 14 and at the other end presses against the nozzle 18 itself.

Figure 4:
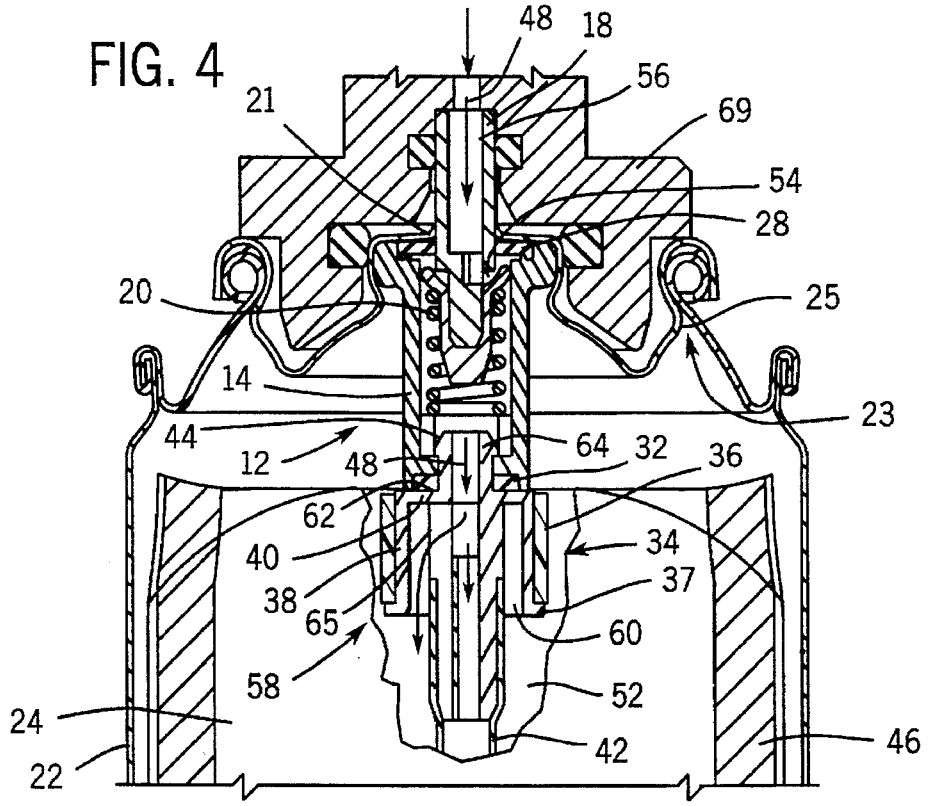
FIG. 4 is a view similar to that shown in FIG. 3, in which a delivery nozzle within the bag is also shown in section and a filling apparatus for filling the bag is disposed on the dispenser valve.

Between the rim 21 of the lid opening 26 and the valve body 14 there is disposed a sealing member such as a washer 28, made for example of rubber, which also provides a leakproof seal around the discharging nozzle 18. This washer 28 closes off the top of the cylindrical, upwardly open valve body 14. That is, it has a dual function. On the one hand, it prevents unintended emergence of material from the bag 24 by way of the interior of the valve body; on the other hand, it is also impossible for medium from the interior of the container 22 unintentionally to reach the exterior. When the nozzle 18 is in its closed position, the washer 28 further serves to close off a lateral discharge aperture 54 that provides access to a discharge channel 56 within the nozzle 18. When the nozzle 18 is pressed in the direction against the action of the compression coil spring 20, the aperture 54 is exposed, as shown in FIG. 4. In this case the discharge channel 56 in the discharging nozzle 18 is in fluid communication with the interior of the valve body, which, as will be described further below, in turn is in fluid communication with the interior of the bag 24.

The valve body 14 has at its lower (in the drawings) end a bore 64 that defines an entrance to the interior cavity defined by the valve body 14. Through this bore 64 a tubular portion 44 of a delivery nozzle 58 can be inserted, so that when fully inserted it is held in place by a catch mechanism. The catch action is achieved by an annular flange projecting radially outward at the end of the tubular portion 44 toward the dispenser valve, which in the assembled state interlocks with the edge of the bore 64 within the valve body 14.

Before it is inserted into the bore 64 of the valve body 14, the tubular portion 44 is pushed through an opening in the bag film, so that in the assembled state the bag 24 is clamped against an additional sealing ring 32 interposed between the delivery tube 58 and the valve body 14. The interposed sealing ring 32 seals the space within the bag off completely from the interior of the container.

The delivery nozzle 58 disposed inside the bag comprises, immediately adjacent to the bag 24, a collar 38 of enlarged diameter, such as in the form of a cylindrical cap 38, that defines an annular bearing surface 40 for the bag film clamped between the delivery nozzle 58 and the valve body 14. This arrangement considerably reduces the danger of the bag tearing out at this place.

Between the cylindrical collar 38 and the part of the delivery nozzle 58 that extends into the bag 24 is defined an annular space 60, which opens (downward in FIG. 4) toward the bag interior 52. At the free end of the cylindrical collar 38 is provided a circumferential rim 37 that projects radially outward.

A sleeve 36 is pushed fitted onto the cylindrical cap 38 and, when pushed fully into place, is seated against the circumferential rim 37.

In the assembled module, the sleeve 36 is held at its upper end by the bag 24.

Figure 3:
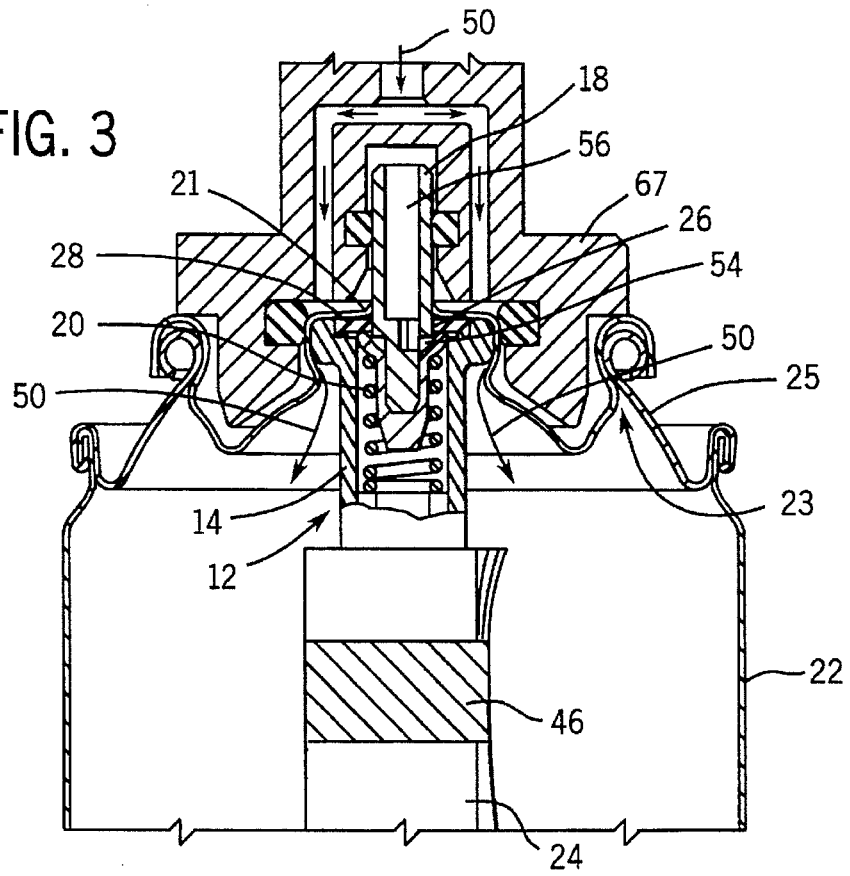
FIG. 3 is a schematic sectional view of the dispenser valve to an enlarged scale, a filling cap for filling the interior of the container having been placed on the dispenser valve.

As shown in FIGS. 1 and 3, the bag 24 is bonded or sealed in a leakproof manner to the sleeve 36.

The dispenser valve 12, namely the valve body 14, the discharge nozzle 18 and the delivery nozzle 58, is made of a material that is both resistant to breaking and impermeable to organic media. Polyacetal, for example, is suitable for this purpose.

In contrast, the sleeve 36 is made of a material that bonds well to the bag 24, i.e. the inner surface of the bag film. Candidate materials here are polyethylene, polypropylene and the like.

Altogether, then, the described construction ensures a high resistance to breakage. In addition, an exchange of media between container and bag is prevented. Furthermore, because the bag is permanently sealed to the dispenser valve 12, the connection between the bag and the dispenser valve is extremely durable.

At the lower end of the delivery nozzle 58 is attached an ascent tube 42, which extends almost to the bottom of the bag 24. This ascent tube 42 also functions to stabilize the bag 24.

The means of filling the space between bag 24 and container 22, and of filling the interior 52 of the bag 24, will now be described.

Figure 5:
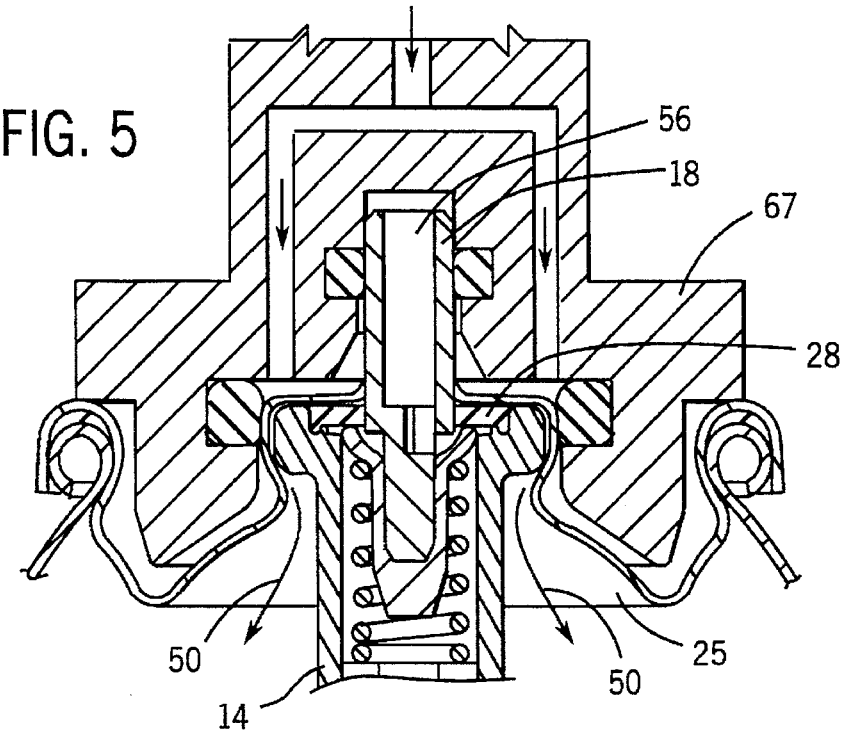
FIGS. 5 and 6 are schematic drawings similar to those of FIGS. 3 and 4, respectively, in which the flow paths of respective media are shown.

As shown in FIG. 3, a filling cap 67 suitable for filling the container 22 is set onto the dispenser valve 12 or the upper end of the container 22. Sealing elements in the form of O-rings operate between the filling cap 67 and the lid 25 on one hand, and between the filling cap 67 and the discharge nozzle 18 on the other hand. Within the filling cap 67 a flow path is formed such that a medium can be introduced into the region in which the discharge nozzle 18 projects out of the lid opening 26. Now when a medium under pressure is supplied by way of the flow paths 50 in the filling cap 67, the washer 28, as can be seen in FIG. 3 and also FIG. 5, is pressed downward, i.e. away from the lid rim 21, into the interior of the container, so that a flow path 50 is formed between the washer 28 and lid 25, and subsequently between the valve body 14 and lid 25. This flow path 50 defines a fluid connection between the filling cap 67 and the interior of the container, so that medium supplied by way of the filling cap 67 can be introduced into the container 22. In the present case, a motive agent or gas is introduced into the interior of the container, preferably air, butane or another environmentally friendly motive agent.

Figure 6:
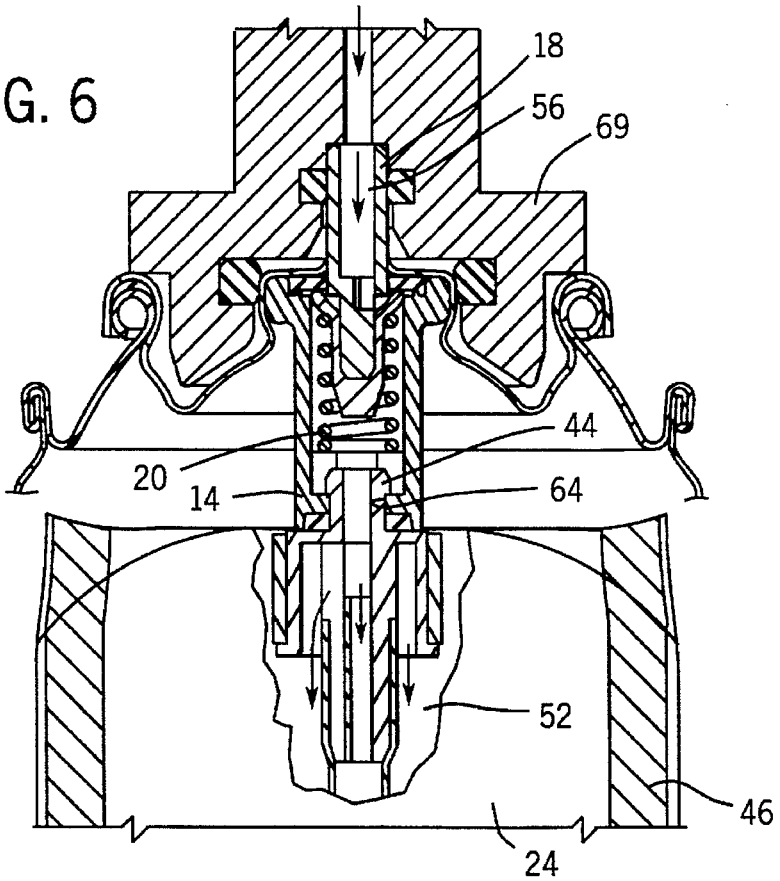

The bag 24 is filled by means of a filling apparatus with a cap 69, as shown in FIGS. 4 and 6, which is sealed off from the discharge nozzle 18 by an O-ring and defines a flow path 48. As the filling cap 69 is put in place, the discharge nozzle 18 is moved against the compression spring 20, from its closed position into an open position. In the latter position the discharge channel 56 is in fluid communication by way of the aperture 54 with the interior of the valve body 14, which in turn opens into the interior of the bag 24 by way of a continuous axial bore through the tubular portion 44 and the delivery nozzle 58. Communication with the bag interior occurs both at the bottom end of the ascent tube 42, i.e. in the lower region of the bag, and at the lateral opening 65 of the delivery 35 nozzle in the region of the annular space 60 in the upper part of the bag 24.

If the space between the bag 24 and container has been filled with butane, and the bag contains for example a gel with isopentane, in the module described above there is no exchange of the organic media. Hence there can also be no pressure equilibration that would make the whole apparatus nonfunctional.

To remove material from the bag, the discharge nozzle 18 is pressed downward against the action of the compression coil spring 20, so that the bag contents are pushed outward as the pressurized gas in the container 22 expands.

With this module an apparatus has been produced that is resistant to breakage, prevents exchange of organic media between the interior of the bag and that of the container, and in addition ensures a good, durable bonding between bag and valve body.

Furthermore, the collar 38 prevents the bag 24 from rapidly tearing free.

In a simplified embodiment the collar 38 can be in the form of a simple disk, which is disposed perpendicular to the delivery nozzle 58 so as to form an annular bearing surface corresponding to the bearing surface 40 for the bag.

What is claimed is:

1. A dispensing module including an outer container having an open end closed by a closing lid and having a lid opening including a rim for dispensing of a pressurized medium from the container, comprising a bag of flexible material, said bag being capable of location within said outer container through said open end and which opening is closed by the lid, a dispenser valve including a valve body attachable to the rim of the lid opening, and having a discharge aperture, a discharge nozzle (58) disposed within the valve body and defining a discharge channel and aligned with said discharge aperture to the valve body, spring means coupled to said discharge nozzle and said valve body and supporting said discharge nozzle, said discharge nozzle for displacement between a closed position and an open position, said spring means urging said discharge nozzle to the closed position, a resilient sealing member disposed between the rim and the valve body and aligned with said discharge nozzle, said discharge nozzle engaging said sealing member in the position and thereby closing the discharge aperture and thereby said discharge channel;

a delivery nozzle (58) disposed within said bag and having a connecting portion abutting the bag, said bag being located between the nozzle and the valve body, said delivery nozzle is formed substantially completely of a fracture-resistant material that is substantially impermeable to organic media, and having said connecting portion having a surface bonded to the bag; and a sealing means between said delivery nozzle and the valve body to permit fluid communication only from the interior of the bag through said delivery nozzle into the valve body.

2. The module of claim 1 wherein said valve body is formed substantially completely of a fracture-resistant material that is substantially impermeable to organic media.

3. The dispensing module of claim 1 wherein the connecting portion of the delivery nozzle that abuts the bag comprises a sleeve of said bondable material, said sleeve being pressure fitted on said nozzle.

4. The dispensing module of claim 1 including a collar is located outwardly of and connected to the nozzle said collar adjoining the bag and forming an annular space around the delivery nozzle, said annular space opening toward the interior of the bag.

5. The dispensing module of claim 4 wherein said collar includes said surface and is bonded to the bag material.

6. The dispensing module of claim 1 wherein said sealing means includes a tubular portion extending from and forming a part of said nozzle, said tubular portion being fitted through said bag opening and into said valve opening whereby said valve body is in fluid communication with the interior of the bag with no leakage into the interior of the outer container.

7. The dispensing module of claim 6 wherein an ascent tube is attached to the delivery nozzle and extends into the bag and substantially to the inner end of the bag.

8. The dispensing module of claim 4 wherein the delivery nozzle includes a lateral opening into the annular space surrounding the delivery nozzle whereby an additional fluid connection to the interior of the bag is defined.

9. The dispensing module of claim 1 wherein the valve body and the delivery nozzle are made of polyacetal material, said connecting portion of said delivery nozzle having said surface selected from the group of polyethylene, polypropylene, and polyamide.

* * * * *